US007118325B2

(12) United States Patent
Kvasnak et al.

(10) Patent No.: US 7,118,325 B2
(45) Date of Patent: Oct. 10, 2006

(54) COOLING PASSAGEWAY TURN

(75) Inventors: William S. Kvasnak, Simpsonville, SC (US); Kenneth K. Landis, Tequesta, FL (US); Hans R. Przirembel, Monterey, TN (US)

(73) Assignee: United Technologies Corporation, Hartford, CT (US)

( * ) Notice: Subject to any disclaimer, the term of this patent is extended or adjusted under 35 U.S.C. 154(b) by 113 days.

(21) Appl. No.: 10/867,282

(22) Filed: Jun. 14, 2004

(65) Prior Publication Data

US 2005/0276698 A1 Dec. 15, 2005

(51) Int. Cl.
*F01D 5/18* (2006.01)

(52) U.S. Cl. ..... 415/115; 416/97 R

(58) Field of Classification Search ..... 415/115, 415/116; 416/96 R, 97 R, 96 A
See application file for complete search history.

(56) References Cited

U.S. PATENT DOCUMENTS 4,753,575 A * 6/1988 Levengood et al. ..... 416/97 R
5,403,159 A * 4/1995 Green et al. ..... 416/97 R
5,498,126 A * 3/1996 Pighetti et al. ..... 415/115
5,511,309 A 4/1996 Beabout
5,741,117 A 4/1998 Clevenger et al.
5,931,638 A 8/1999 Krause et al.
6,471,479 B1 10/2002 Starkweather
6,634,858 B1 10/2003 Roeloffs et al.
2001/0018024 A1 8/2001 Hyde et al.

* cited by examiner

*Primary Examiner*—Edward K. Look
*Assistant Examiner*—Dwayne J White
(74) *Attorney, Agent, or Firm*—Bachman & LaPointe, P.C.

(57) ABSTRACT

An internally-cooled turbomachine element has an airfoil extending between inboard and outboard ends. A cooling passageway is at least partially within the airfoil and has at least a first turn. Means are in the passageway for limiting a turning a loss of the first turn. The turbomachine element may result from a reengineering of an existing element configuration lacking such means.

30 Claims, 5 Drawing Sheets

COOLING PASSAGEWAY TURN

U.S. GOVERNMENT RIGHTS

The invention was made with U.S. Government support under contract N00019-97-C-0050 awarded by the U.S. Navy. The U.S. Government has certain rights in the invention.

BACKGROUND OF THE INVENTION

The invention relates to the cooling of turbomachine components. More particularly, the invention relates to internal cooling of gas turbine engine blade and vane airfoils.

A well developed art exists regarding the cooling of gas turbine engine blades and vanes. During operation, especially those elements of the turbine section of the engine are subject to extreme heating. Accordingly, the airfoils of such elements typically include serpentine internal passageways. Exemplary passageways are shown in U.S. Pat. Nos. 5,511,309, 5,741,117, 5,931,638, 6,471,479, and 6,634,858 and U.S. patent application publication 2001/0018024A1.

Nevertheless, there remains room for improvement in the configuration of cooling passageways.

SUMMARY OF THE INVENTION

One aspect of the invention involves an internally-cooled turbomachine element comprising an airfoil extending between inboard and outboard ends. A cooling passageway is at least partially within the airfoil and has at least a first turn. Means in the passageway limit a turning loss of the first turn.

In various implementations, the means may comprise a wall essentially dividing the entirety of the first turn into first and second flowpath portions. A leading end of the wall may be upstream of the first turn (e.g., by at least 1.0 hydraulic diameters or, more narrowly, at least 1.5 hydraulic diameters, with an exemplary 1.5–2.5 or 1.5–2.0). The turn may be in excess of 90° or 120° and may be essentially 180°. The turn may be around an end of a wall. The element may have at least a first airfoil end feature selected from the group consisting of an inboard platform and an outboard shroud. The first turn may be at least partially within the first airfoil end feature.

Another aspect of the invention involves an internally-cooled turbomachine element having an airfoil extending between inboard and outboard ends. Internal surface portions define a cooling passageway at least partially within the airfoil. The cooling passageway has a first turn from a first leg to a second leg. A dividing wall bifurcates the cooling passageway into first and second portions and extends within the cooling passageway along a length from a wall first end to a wall second end. The first and second portions may each provide 25–75% of a cross-sectional area of the cooling passageway along said length of said wall, more narrowly, 35–65%.

The passageway may have a second turn from the second leg to a third leg. The wall first end may be proximate an end of the first leg at the first turn. The wall second end may be proximate an end of the third leg at the second turn. The wall first end may be 1.0–3.0 hydraulic diameters from the end of the first leg at the first turn. The wall second end may be 1.0–3.0 hydraulic diameters from the end of the third leg at the second turn. At the first turn, the passageway first portion may be within the second portion. At the second turn, the passageway second portion may be within the first portion. At the first turn, the passageway first portion may have a smaller cross-sectional area than the second portion. At the second turn, the passageway second portion may have a smaller cross-sectional area than the first portion. At the first turn, the passageway first portion may have a cross-section that is less wide than a cross-section of the second portion. At the second turn, the passageway second portion may have a cross-section that is less wide than a cross-section of the first portion. At the first turn, the passageway first portion may have a cross-section that is less elongate than a cross-section of the second portion. At the second turn, the passageway second portion may have a cross-section that is less elongate than a cross-section of the first portion. The element may be a vane having an inboard platform and an outboard shroud. The wall may have a number of apertures therein. The apertures may be no closer than an exemplary two hydraulic diameters from the first turn.

Another aspect of the invention involves a method for reengineering a configuration for an internally-cooled turbomachine element from a baseline configuration to a reengineered configuration. The baseline configuration has an internal passageway having first and second legs and a first turn therebetween. The method includes adding a wall to bifurcate the passageway into first and second portions. The wall extends within the passageway along a length from a wall first end to a wall second end. Otherwise, a basic shape of the first cooling passageway is essentially maintained.

In various implementations, the first cooling passageway may be slightly enlarged to at least partially compensate for a loss of cross-sectional area resulting from the addition of the wall.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
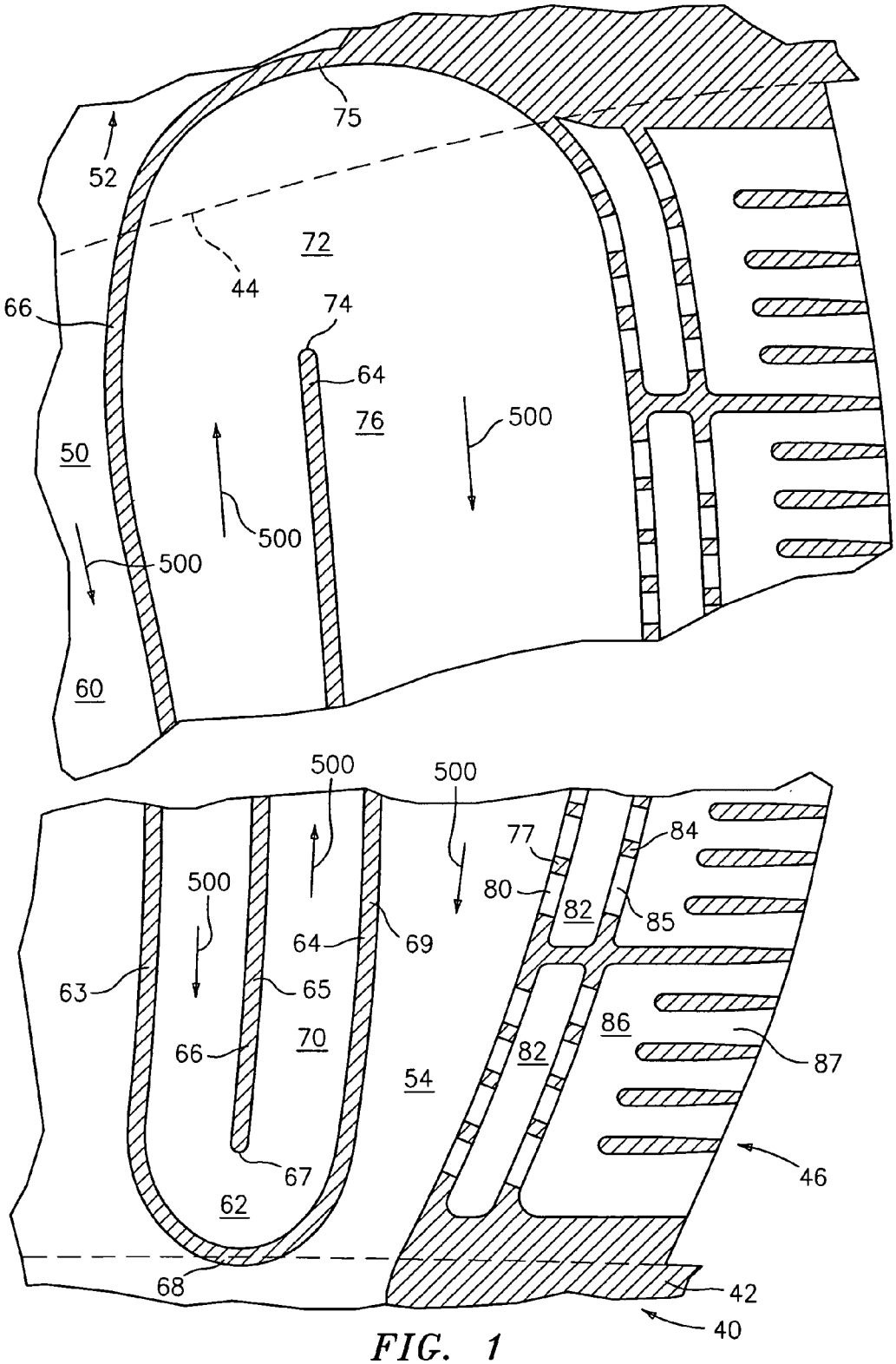
FIG. 1 (PRIOR ART)
FIG. 1 is a partial, cut-away, partially-schematic, medial sectional view of a prior art airfoil.

FIG. 1 shows a turbine element 40 shown as an exemplary vane having an inboard platform 42 and an outboard shroud 44. An airfoil 46 extends from an inboard end at the platform to an outboard end at the shroud and has a leading edge (not shown) and a trailing edge 48 separating pressure and suction side surfaces. In the exemplary airfoil, one or more passageways of a cooling passageway network extend at least partially through the airfoil. In the exemplary airfoil, one passageway 50 extends in a downstream direction 500 along a cooling flowpath from an inlet 52 in the shroud to an exemplary closed downstream passageway end 54 which may be closed or may communicate with a port in the platform.

An upstream first leg 60 of the passageway 50 extends from an upstream end at the inlet 52 to a downstream end at a first turn 62 of essentially 180°. The first leg 60 is bounded by: an adjacent surface of a first portion 63 of a first wall 64; a first portion 65 of a second wall 66; and adjacent portions of passageway pressure and suction side surfaces (not discussed further regarding other portions of the passageway). The exemplary second wall 66 extends downstream to an end 67 at the first turn 62. A second portion 68 of the first wall 64 extends along the periphery of the first turn 62. A second passageway leg 70 extends downstream from a first end at the center of the first turn 62 to a second end at a second turn 72. The second leg 70 is bounded by a continuation of the first surface of the wall 64 along a third portion 69 thereof and by an opposite second surface of the second wall 66. The first wall 64 and its third portion 69 extend to an end 74 at the center of the second turn 72. A second portion 75 of the second wall 66 extends along the periphery of the second turn 72.

A third passageway leg 76 extends from a first end at the second turn 72 to a second end defined by the passageway end 54. The third leg 76 is bounded by: a second surface of the first wall third portion 69 opposite the first surface thereof and extending downstream along the path 500 from the wall end 74; and a continuation of the second surface of the second wall 66 along a third portion 77 thereof. Along a portion of the third leg 76, the exemplary second wall third portion 77 includes an array of impingement holes 80 extending into one or more impingement cavities or chambers 82. An impingement cavity downstream wall 84 having apertures 85 separates the impingement cavities 82 from an outlet cavity 86. An array of trailing edge cooling holes or slots 87 extend from the cavity 86 to the trailing edge.

In operation, a cooling airflow passes downstream along the flowpath 500 from the inlet 52 through the first leg 60 in a generally radially inboard direction relative to the engine centerline (not shown). The flow is turned outboard at the first turn 62 and proceeds outboard through the second leg 70 to the second turn 72 where it is turned inboard to pass through the third leg 76. While passing through the third leg 76, progressive amounts of the airflow are bled through the holes 80 into the impingement cavities 82. From the impingement cavities 82, the airflow passes out through the holes 85 into the outlet cavity 86. From the outlet cavity 86, the flow passes through holes/slots 87 to cool a trailing edge portion of the airfoil.

Viewed in cross-section transverse to the downstream direction, the exemplary passageway 50 is roughly transversely elongate rectangular (i.e., a radial span is substantially less than a height). In general, turning losses tend to increase with elongate passageway cross-sections (e.g., height much greater or less than radial span) and with sharper turns. Partially splitting the passageway into portions whose cross-sections (at least for one of the portions) are closer to square may reduce aerodynamic turning losses. In particular, an inboard portion may be made relatively less elongate than an outboard portion. The outboard portion may rely on a greater characteristic turn radius of curvature (e.g., mean or median) to maintain an advantageously low level of turning losses.

Figure 2:
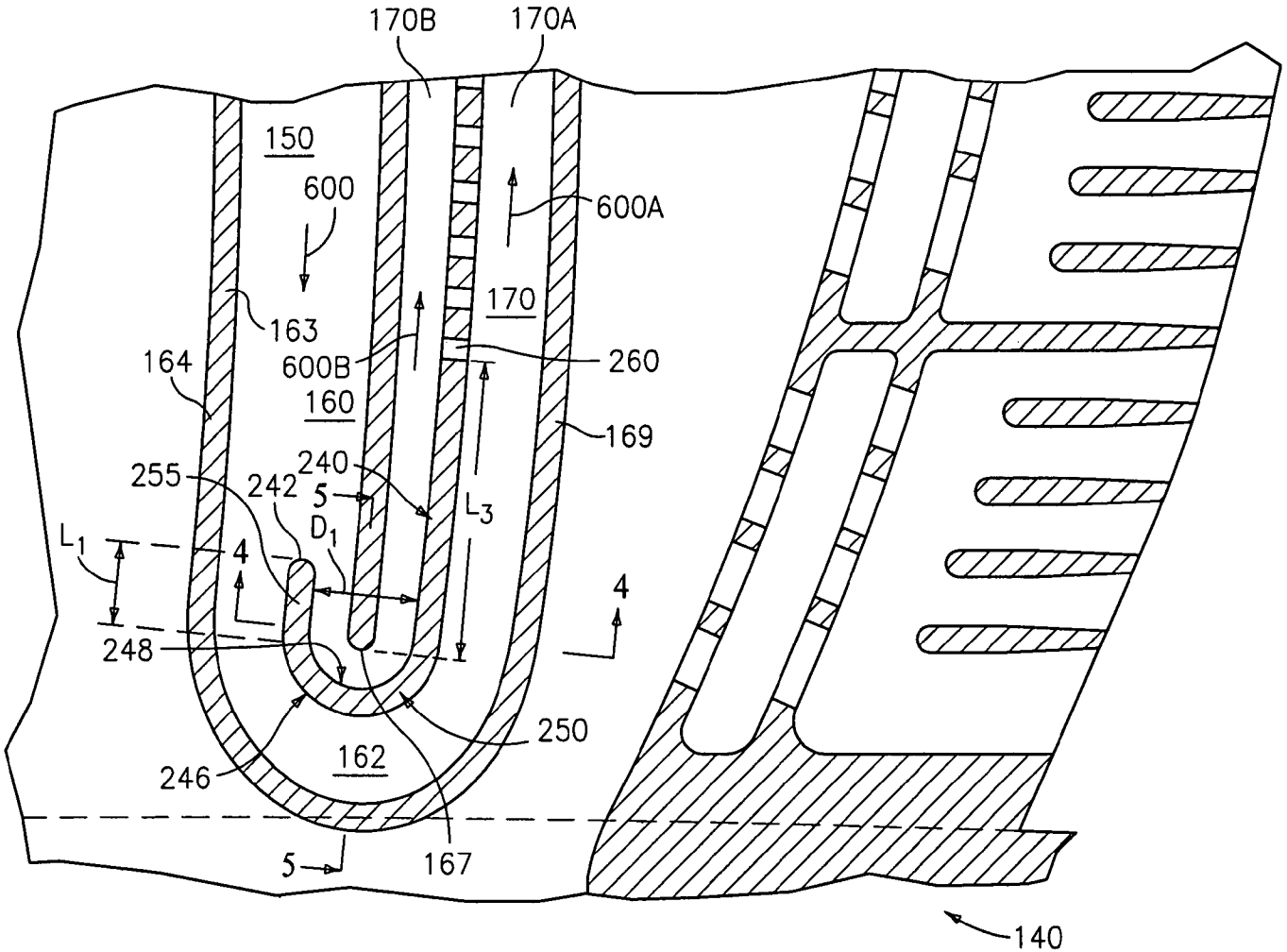
FIG. 2 is a partial, cut-away, partially-schematic, medial sectional view of an inboard portion of an airfoil according to principles of the invention.
Figure 3:
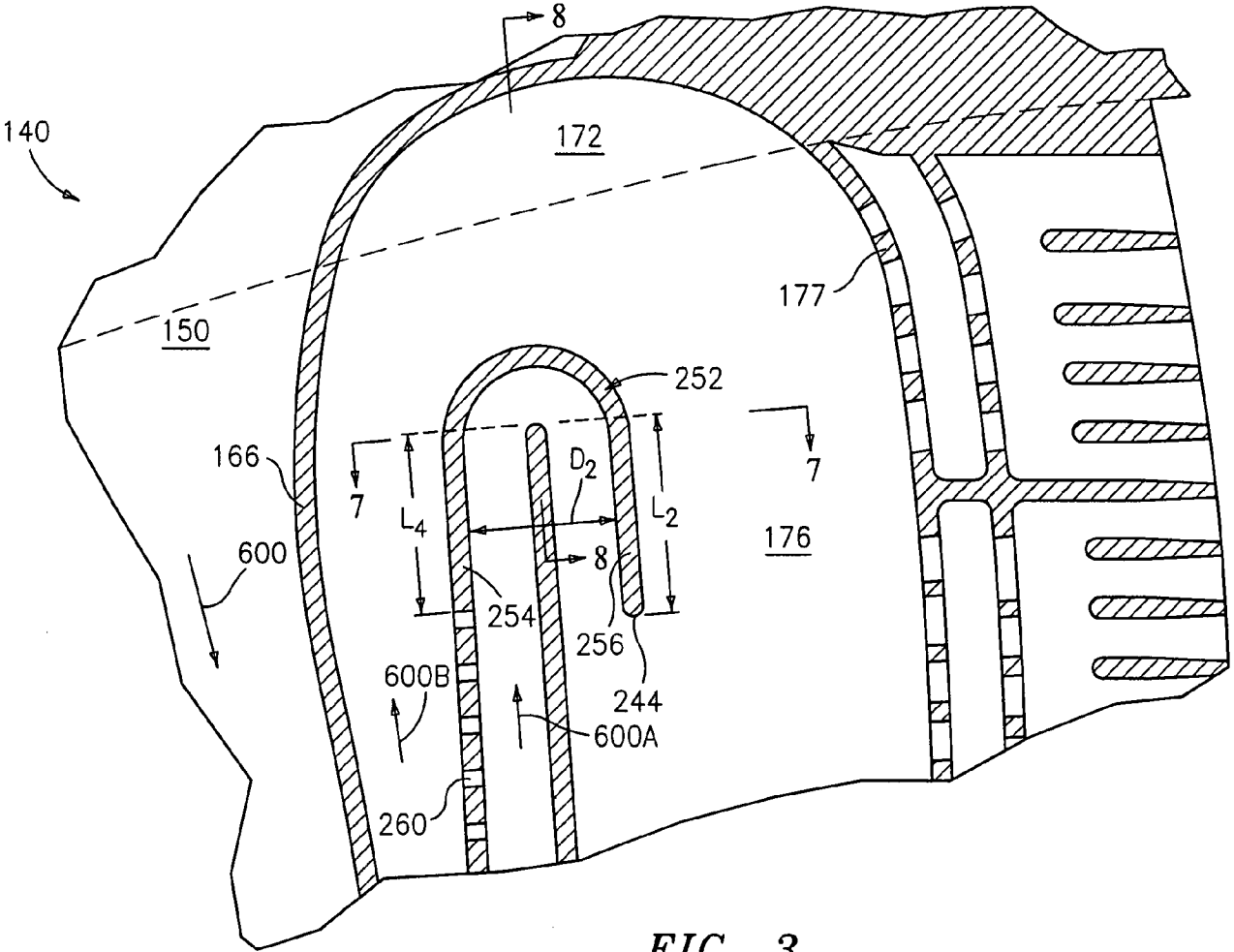
FIG. 3 is a partial, cutaway, partially schematic, medial sectional view of an outboard portion of an airfoil according to principles of the invention.
Figure 7:
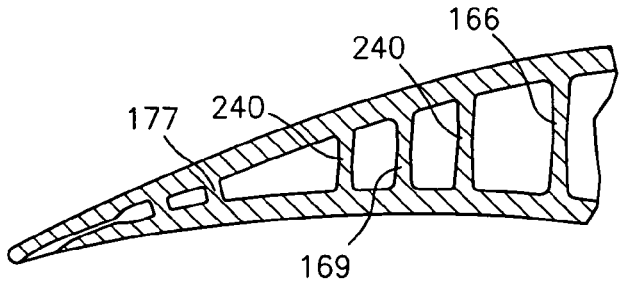
FIG. 7 is a sectional view of the airfoil of FIG. 3, taken along line 7—7.

FIGS. 2 and 3 show a vane 140 which may be formed as a reengineered version of the vane 40 of FIG. 1. The exemplary reengineering preserves the general cooling passageway configuration (e.g., the shape and approximate positioning and dimensioning of the walls and other structural elements) but adds an exemplary single dividing wall 240 within the first passageway 150. For ease of reference, elements analogous to those of the vane 40 are referenced with like reference numerals incremented by one hundred. The exemplary dividing wall 240 extends from a first end 242 (FIG. 2) to a second end 244 (FIG. 3) and has generally first and second surfaces 246 and 248. The dividing wall 240 locally splits or bifurcates the passageway 150 into portions 150A and 150B and the flowpath 600 into first and second flow portions 600A and 600B. In the exemplary airfoil, this bifurcation starts near the downstream end of the first leg 160 and extends through the first turn 162, second leg 170, second turn 172, to near the first (upstream) end of the third leg 176 where the flow portions fully rejoin. In the exemplary embodiment, the bifurcation and rejoinder advantageously occur within the respective first and third legs (as further discussed below), although they may alternatively occur within the first and second turns.

To preserve total cross-sectional area along the bifurcated flowpath, the walls defining the flowpath may be shifted slightly relative to the baseline airfoil of FIG. 1. For example, with a first portion 163 (FIG. 2) of the first wall 164 fixed relative to its FIG. 1 counterpart, the third portion 169 may be shifted somewhat toward the airfoil trailing edge. The third portion 177 of the second wall 166 may be similarly shifted relative to its counterpart (potentially shrinking the size of any impingement or outlet cavity or being associated with a switch from double impingement to single impingement if exterior airfoil shape and dimensions are essentially maintained).

The exemplary wall 240 has an approximately S-shaped planform with arcuate first and second turn portions 250 and 252 and a relatively straight leg 254 therebetween. Portions 250 and 252 are shown having diameters $D_1$ and $D_2$, although they may be other than semicircular. Near the ends 242 and 244, associated end portions 255 and 256 may be relatively straight and taper to provide smooth flow split and rejoinder and may extend by lengths $L_1$ and $L_2$ beyond the turns.

Figure 6:
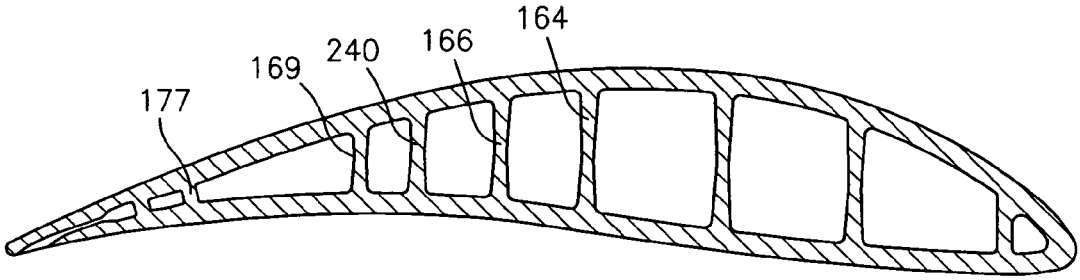
FIG. 6 is a sectional view of the airfoil of FIGS. 2 and 3 at an intermediate location.
Figure 4:
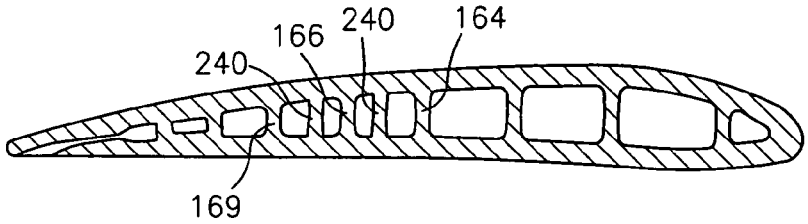
FIG. 4 is a partial sectional view of the airfoil of FIG. 2, taken along line 4—4.
Figure 5:
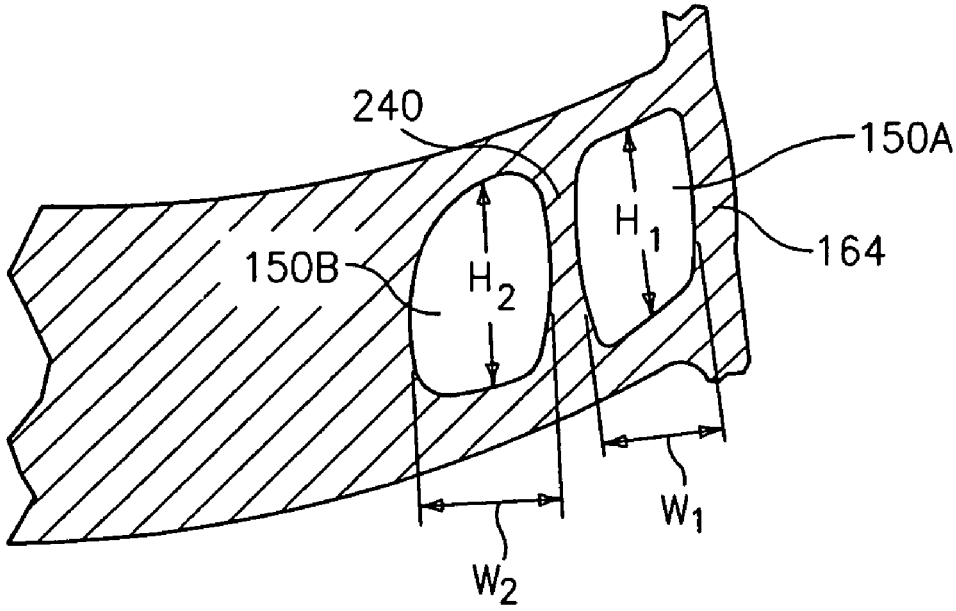
FIG. 5 is a partial sectional view of the airfoil of FIG. 2, taken along line 5—5.
Figure 8:
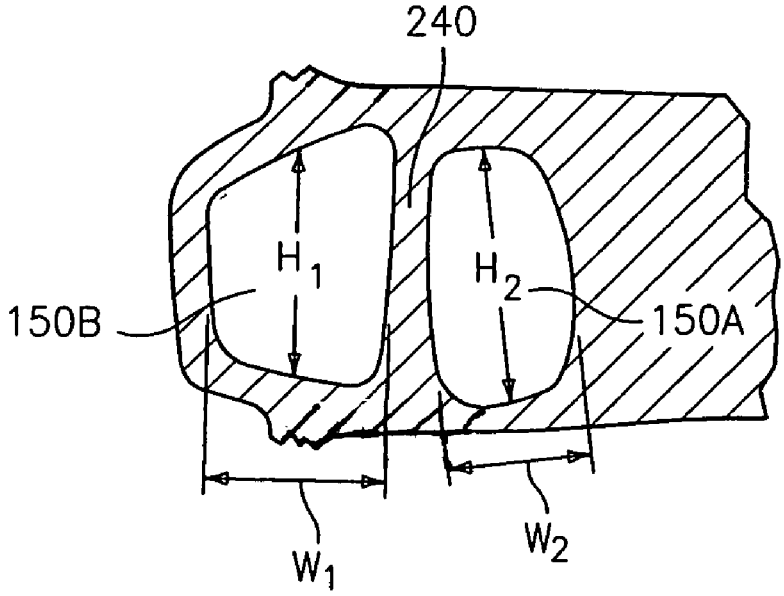
FIG. 8 is a partial sectional view of the airfoil of FIG. 3, taken along line 8—8.

FIG. 6 shows the sections of the passageway portions 150A and 150B having characteristic heights $H_1$ and $H_2$ between interior pressure and suction side surfaces and characteristic widths $W_1$ and $W_2$ between adjacent walls. $H_1$ and $H_2$ and $W_1$ and $W_2$ may vary slightly around each turn. At the second turn, however, the relative transverse elongatedness of the two passageway portions is reversed. This permits whichever of the two portions is inboard at each of the turns to have a less elongate cross-section.

To achieve the switch between the first and second turns, the dividing wall 240 extends generally diagonally across the passageway second leg 170. To equalize pressure across the wall 240 during this transition, the leg 254 has a row of apertures 260 along a central portion thereof. Advantageously, the upstream and downstream ends of the row are recessed from the upstream and downstream ends of the leg 170. FIGS. 2 and 3 show such recessing by lengths $L_3$ and $L_4$. To minimize losses, advantageously, entering each turn, the dividing wall is continuous from upstream of such turn by a sufficient distance to provide desired flow through the turn, but not so far as to add unnecessary drag in the straight portion of the passageway leg thereahead. Advantageously, it may be continuous by at least one hydraulic diameter (of the inboard passageway portion at the adjacent end of the associated turn), more particularly, between about 1.5 and 2.0 hydraulic diameters. Accordingly, $L_1$ and $L_4$ may advantageously be of such dimension. Similarly, the wall may continuously extend downstream of the turn by a similar figure. Thus, $L_2$ and $L_3$ may be similar. Hydraulic diameter is defined as $D_H$=4A/P, where A is the cross-sectional area and P is the wetted perimeter of the cross-section.

In the exemplary reengineering, the first turn 62 may have a turn loss parameter $K_T$. The loss parameters for the outer and inner portions of the turn 162 (i.e., along first and second passageway portions 150A and 150B) may be substantially reduced, the loss along the outer portion being reduced by a greater factor due to the greater characteristic radius of curvature. For example, with an existing turn of loss parameter in the vicinity of 3.5–4, the reengineered turn may have an inboard portion of loss parameter in the vicinity of 2.0–2.5 and an outboard portion with loss parameter below 1.5, if not below 1.0. The second turn may see similar changes.

In other embodiments, the wall may be continuous between the two turns. In yet other embodiments, a wall may only extend through a single turn, although there may be individual walls for each of several turns. Depending on part geometry, the possibility exists of adding multiple walls for a given turn or turns.

One or more embodiments of the present invention have been described. Nevertheless, it will be understood that various modifications may be made without departing from the spirit and scope of the invention. For example, the principles may be applied to the reengineering of a variety of existing passageway configurations. Any such reengineering may be influenced by the existing configuration. Additionally, the principles may be applied to newly-engineered configurations. Accordingly, other embodiments are within the scope of the following claims.

What is claimed is:

1. An internally-cooled turbomachine element comprising:

an airfoil extending between inboard and outboard ends;

a cooling passageway at least partially within the airfoil and having at least a first turn; and means in the passageway for limiting a turning loss of the first turn and comprising a wall essentially dividing the entirety of the first turn into first and second flowpath portions, a leading end of the wall being 1.0–3.0 hydraulic diameters upstream of the first turn.

2. The element of claim 1 wherein:

said leading end of the wall is 1.5–2.0 hydraulic diameters upstream of the first turn.

3. The element of claim 1 wherein:

the wall extends uninterrupted from upstream of the first turn to downstream of the first turn.

4. The element of claim 1 wherein:

the wall extends uninterrupted from at least 1.0 hydraulic diameters upstream of the first turn to at least a midpoint of the first turn.

5. The element of claim 1 wherein:

the turn is in excess of 90°.

6. The element of claim 1 wherein:

the turn is around an end of a wall;

the element has at least a first airfoil end feature selected from the group consisting of an inboard platform and an outboard shroud; and the first turn is at least partially within the first airfoil end feature.

7. An internally-cooled turbomachine element comprising:

an airfoil extending between inboard and outboard ends; and internal surface portions defining a cooling passageway at least partially within the airfoil, wherein:

the cooling passageway has a first turn from a first leg to a second leg;

a dividing wall bifurcates the cooling passageway into first and second portions and extends within the passageway along a length from a wall first end to a wall second end; and the wall first end is 1.0–3.0 hydraulic diameters from an end of the first leg at the first turn.

8. The element of claim 7 wherein:

the first and second portions each provide 35–65% of a cross-sectional area of the cooling passageway along said length of the wall.

9. The element of claim 7 wherein:

the passageway has a second turn from the second leg to a third leg;

the wall second end is proximate an end of the third leg at the second turn.

10. The element of claim 7 wherein:

the passageway has a second turn from the second leg to a third leg;

the wall first end is 1.5–2.0 hydraulic diameters from an end of the first leg at the first turn; and the wall second end is 1.0–3.0 hydraulic diameters from an end of the third leg at the second turn.

11. The element of claim 7 wherein:

the passageway has a second turn from the second leg to a third leg;

at the first turn, the passageway first portion is within the second portion; and at the second turn, the passageway second portion is within the first portion.

12. The element of claim 11 wherein:

at the first turn, the passageway first portion has a smaller cross sectional area than the second portion; and at the second turn, the passageway second portion has a smaller cross sectional area than the first portion.

13. The element of claim 11 wherein:

at the first turn, the passageway first portion has a cross-section that is less wide than a cross-section of the second portion; and at the second turn, the passageway second portion has a cross-section that is less wide than a cross-section of the first portion.

14. The element of claim 11 wherein:

at the first turn, the passageway first portion has a cross-section that is less elongate than a cross-section of the second portion; and at the second turn, the passageway second portion has a cross-section that is less elongate than a cross-section of the first portion.

15. The element of claim 7 being a vane and having:

an inboard platform; and an outboard shroud.

16. The element of claim 7 wherein:

the wall has a plurality of apertures therein.

17. The element of claim 16 wherein:

the plurality of apertures are no closer than two hydraulic diameters from the first turn.

18. A method for reengineering a configuration for an internally-cooled turbomachine element from a baseline configuration to a reengineered configuration wherein the baseline configuration has an internal passageway having first and second legs and a first turn therebetween, the method comprising:

adding a wall to bifurcate the passageway into first and second portions, the wall extending within the passageway along a length from a wall first end to a wall second end; and otherwise essentially maintaining a basic shape of the first cooling passageway.

19. The method of claim 18 wherein:

the first turn is around an end of a second wall.

20. The method of claim 18 wherein:

the wall has a series of apertures.

21. The method of claim 18 wherein:

the wall extends at least 90°around the first turn;

at the first turn, the first portion is within the second portion; and at the first turn, a cross-section of the first portion is narrower than a cross-section of the second portion.

22. The method of claim 18 wherein:

the wall extends at least 120°around the first turn;

at the first turn, the first portion is within the second portion; and at the first turn, a cross-section of the first portion is less elongate than a cross-section of the second portion.

23. The method of claim 18 wherein:

the wall first end is 1.0–3.0 hydraulic diameters from an end of the first leg at the first turn.

24. An internally-cooled turbomachine element comprising:

an airfoil extending between inboard and outboard ends; and internal surface portions defining a cooling passageway at least partially within the airfoil, wherein:

the cooling passageway has a first turn from a first leg to a second leg;

a dividing wall bifurcates the cooling passageway into first and second portions and extends within the passageway along a length from a wall first end to a wall second end;

the passageway has a second turn from the second leg to a third leg;

the wall first end is 1.0–3.0 hydraulic diameters from an end of the first leg at the first turn; and the wall second end is 1.0–3.0 hydraulic diameters from an end of the third leg at the second turn.

25. An internally-cooled turbomachine element comprising:

an airfoil extending between inboard and outboard ends; and internal surface portions defining a cooling passageway at least partially within the airfoil, wherein:

the cooling passageway has a first turn from a first leg to a second leg;

a dividing wall bifurcates the cooling passageway into first and second portions and extends within the passageway along a length from a wall first end to a wall second end;

the passageway has a second turn from the second leg to a third leg;

at the first turn, the passageway first portion is within the second portion; and at the second turn, the passageway second portion is within the first portion.

26. The element of claim 25 wherein:

at the first turn, the passageway first portion has a smaller cross sectional area than the second portion; and at the second turn, the passageway second portion has a smaller cross sectional area than the first portion.

27. The element of claim 25 wherein:

at the first turn, the passageway first portion has a cross-section that is less wide than a cross-section of the second portion; and at the second turn, the passageway second portion has a cross-section that is less wide than a cross-section of the first portion.

28. The element of claim 25 wherein:

at the first turn, the passageway first portion has a cross-section that is less elongate than a cross-section of the second portion; and at the second turn, the passageway second portion has a cross-section that is less elongate than a cross-section of the first portion.

29. An internally-cooled turbomachine element comprising:

an airfoil extending between inboard and outboard ends; and internal surface portions defining a cooling passageway at least partially within the airfoil, wherein:

the cooling passageway has a first turn from a first leg to a second leg;

a dividing wall bifurcates the cooling passageway into first and second portions and extends within the passageway along a length from a wall first end to a wall second end;

the wall has a plurality of apertures therein; and the plurality of apertures are no closer than two hydraulic diameters from the first turn.

30. An internally-cooled turbomachine element comprising:

an airfoil extending between inboard and outboard ends; and internal surface portions defining a cooling passageway at least partially within the airfoil, wherein:

the cooling passageway has a first turn from a first leg to a second leg;

a dividing wall bifurcates the cooling passageway into first and second portions and extends within the passageway along a length from a wall first end to a wall second end;

the passageway has a second turn from the second leg to a third leg;

the wall first end is proximate an end of the first leg at the first turn; and the wall second end is proximate an end of the third leg at the second turn.

* * * * *